United States Patent [19]

Stemmle

[11] 4,355,880

[45] Oct. 26, 1982

[54] FORWARD ORDER DOCUMENT COPYING METHOD

[75] Inventor: Denis J. Stemmle, Williamson, N.Y.

[73] Assignee: Xerox Corporation, Stamford, Conn.

[21] Appl. No.: 155,868

[22] Filed: Jun. 2, 1980

[51] Int. Cl.[3] ..... G05G 15/00; B65H 5/00

[52] U.S. Cl. ..... 355/3 SH; 271/3.1; 355/14 SH

[58] Field of Search ..... 355/3 SH, 14 SH, 26; 271/3.1, 4, 65, 186, DIG. 9

[56] References Cited

U.S. PATENT DOCUMENTS

| | | | |
|---|---|---|---|
| 3,937,454 | 2/1976 | Colwill | 271/6 |
| 4,076,408 | 2/1978 | Reid et al. | 355/14 |
| 4,078,787 | 3/1978 | Burlew et al. | 271/3.1 |
| 4,099,150 | 7/1978 | Connin | 355/3 R |
| 4,099,860 | 7/1978 | Connin | 355/14 |
| 4,109,903 | 8/1978 | Stange et al. | 271/3 |
| 4,140,387 | 2/1979 | Gustafson | 355/14 |
| 4,158,500 | 6/1979 | DiFrancesco et al. | 355/14 SH |
| 4,166,614 | 9/1979 | Hamlin et al. | 271/3.1 |
| 4,169,674 | 10/1979 | Russel | 355/14 |
| 4,176,945 | 12/1979 | Holzhauser et al. | 355/23 |
| 4,179,215 | 12/1979 | Hage | 355/50 |
| 4,229,101 | 10/1980 | Hamlin et al. | 355/77 |
| 4,234,180 | 11/1980 | Looney | 271/3.1 |
| 4,278,344 | 7/1981 | Sahay | 355/14 SH |
| 4,284,270 | 8/1981 | Silverberg | 271/166 |

FOREIGN PATENT DOCUMENTS

| | | |
|---|---|---|
| 22680 | 1/1981 | European Pat. Off. . |
| 24936 | 3/1981 | European Pat. Off. . |
| 1128295 | 10/1962 | Fed. Rep. of Germany . |
| 2150563 | 4/1973 | Fed. Rep. of Germany . |
| 2000749 | 1/1979 | United Kingdom . |

OTHER PUBLICATIONS

Research Disclosure No. 15671, Apr. 1977, pp. 80–82, "Apparatus for Producing Collated Copies in Page Sequential Order", DiFrancesco et al.

IBM Technical Disclosure Bulletin, vol. 14, No. 5, Oct. 1971, p. 1547, "Document Feed", Rogers et al.

*Primary Examiner*—S. J. Witkowski

*Assistant Examiner*—Keith E. George

[57] ABSTRACT

A method of recirculative precollation copying of simplex documents in forward serial page order by stacking the set of simplex document sheets in proper page order, but face-down and overlying the imaging station, and circulating the document set in its first and last circulations through a non-inverting reversing document path between the stack and the imaging station. In all other circulations of the document set the documents circulate through a different, unidirectional, document path with two inversions, with a single inversion between the stack and the imaging station and another common inversion between the imaging station and the stack used in all circulations, to provide proper simplex/duplex copying of an odd or even number of simplex documents without counting them before they are copied.

7 Claims, 3 Drawing Figures

1 TO N SIMPLEX / DUPLEX

N TO 1 SIMPLEX / DUPLEX

FORWARD ORDER DOCUMENT COPYING METHOD

Figure 1:
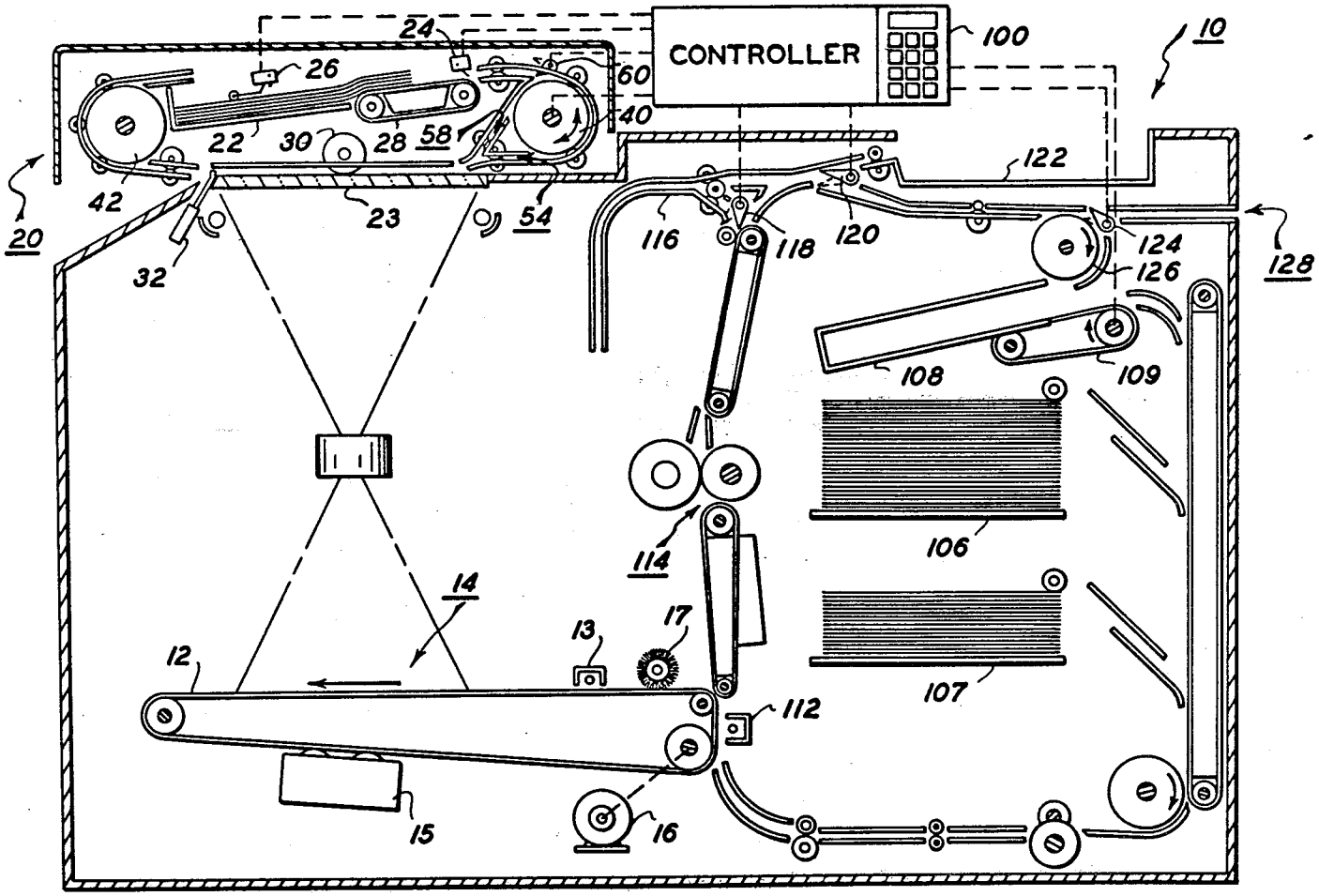

The present invention relates to an improved document handling system for providing recirculatory pre-collation copying of documents in normal forward order from a stack over the imaging station of a copier.

Document circulating and inverting apparatus disclosed herein is also disclosed, but not similarly claimed, in a copending U.S. application Ser. No. 71,613 filed Aug. 31, 1979 by Ravi B. Sahay and the same assignee, now U.S. Pat. No. 4,278,344 issued July 14, 1981 the benefit of which disclosure is claimed herein and incorporated by reference. One advantage of the present invention is that it may be used alternatively or interchangably with that same apparatus and copy process with little, if any, modification. However, it is not limited thereto and is unable with various other document handling apparatus and copiers as will be apparent from the following description.

As xerographic and other copiers increase in speed, and become more automatic, it is increasingly important to provide higher speed yet more reliable and more automatic handling of both the copy sheets and the original documents being copied, i.e. both the output and input of the copier. The providing of duplex document sheet copying greatly complicates and increases the document and copy sheet handling complexities.

The following terminology is generally used in the description herein: The term "sheet" generally refers to conventional sized sheets of paper, plastic, or other conventional or typical individual image substrates (original or copy), and not to microfilm or electronic images which are generally much easier to manipulate. The term "page" here generally refers to one side or "face" of a sheet or the image thereon. A "simplex" document or copy sheet is one having its page and image on only one side or face of the sheet, whereas a "duplex" document or copy sheet has pages on both sides. The term "duplex copying" may be more specifically defined into several different known copying modes. In "duplex/duplex" copying, both sides (both pages) of a duplex document sheet are copied onto both sides of a copy sheet. In "duplex/simplex" copying, both sides of a duplex document are copied onto one side of two successive copy sheets. In "simplex/duplex" copying, the two page images of two successive simplex document sheets are copied onto the opposite sides of a single copy sheet. In non-duplex copying, i.e. "simplex/simplex" copying, one side of each simplex document is copied onto one side of each copy sheet. In the printing industry, as opposed to the copier industry, two-sided copying may be referred to as "backing-up" rather than duplex copying. A commercially desirable pre-collation document handling system should compatibly provide all of these copying modes. However, "duplex/simplex" is generally less desirable and need not be provided.

The present invention particularly relates to a "simplex/simplex" and "simplex/duplex" copying system which is fully compatible, with the same apparatus, with all of the other said copying systems. "RDH" and "ADH" and "SADH" are abreviations for recirculating, automatic and semi-automatic document handlers, respectively. In an RDH or ADH documents are automatically fed from a stack and returned, whereas in an SADH they are inserted individually.

All of these copying systems may be pre-collation or non-pre-collation (explained below). The present invention is particularly suitable for pre-collation, multiply recirculated, document copying, but is also highly compatible with non-pre-collation copying.

By way of further background as to known difficulties in integrating simplex or duplex document recirculation with duplex copying, in a properly collated set of duplex document or duplex copy sheets the odd pages 1, 3, 5, etc., should normally appear on the first or front faces or sides, and only the next higher page number even pages 2, 4, 6, etc., should normally be on the respective second or back sides. Also, the number of duplex sheets will always be less than the number of pages on those duplex sheets. In contrast, in a set of simplex document or copy sheets, the number of the sheet will typically also correspond to the page number. Thus, an odd number of simplex sheets will normally also have a corresponding odd number of page images. However, a set of duplex sheets, regardless of the sheet count, may have an odd or even number of pages. If there are an odd number of pages in the set of duplex sheets the backside of the last sheet will normally be blank (empty). In a recirculatory document handling apparatus it is known (and simple) to count the number of sheets in a set, but it is much more expensive to "read" them to determine if they have pages or are blank. Other difficulties involved in efficient duplexing systems and sequences, which are compatible with both simplex and duplex systems, are discussed in the art cited herein and other duplexing art.

Pre-collation copying is a known desirable feature for a copier. As discussed, for example, in detail in U.S. Pat. Nos. 3,963,345, issued June 15, 1976, to D. J. Stemmle, et al., at Columns 1–4, and 4,116,558, issued Sept. 26, 1978, to J. A. Adamek et al., pre-collation copying provides a number of important advantages. For pre-collation copying any desired number of pre-collated copy sets may be made by making a corresponding number of recirculations of the document set in collated order past a copying station and copying each document only once each time it recirculates. The copies exit the copier in pre-collated sets, and do not require subsequent sorting in a sorter or collator. On-line finishing and/or removal of the completed copy sets may thus be provided while further copy sets are being made from the subsequent circulations of the same document set.

The above-cited Adamek patent teaches an efficient RDH system for making duplex pre-collated copy sets compatible with simplex copying and usable with the present invention, in which all of the documents may be recirculatively copied on all but the first and last copying circulations, in which alternate documents are copied (by circulating all documents but not exposing alternate ones) to form and remove a duplex copy buffer set. This is also described in the Hamlin et al. patents cited herein.

However, a disadvantage of pre-collation copying systems is that the documents must all be repeatedly circulated, and copied in a pre-determined order only once in each circulation, by a number of circulations equivalent to the desired number of copy sets. Thus, increased document handling is necessitated for a pre-collation copying system, as compared to a conventional post-collation copying system. Therefore, maximizing document handling automation and copying cycle efficiency is particularly important in pre-collation copying. If the document handler cannot efficiently and rapidly circulate and copy documents in coordination with copy sheets in the correct order, or must skip documents or copying cycles, the total copying time for each copy set will be increased. Minimizing the time delay from the initiation of copying until the first copy set comes out is also an important factor. This is known as "first copy out time".

In contrast, in a post-collation copying system, plural copies are made at one time from each document page and collated by being placed in separate sorter bins. The document set need only be circulated or fed once and multiply copied during that circulation to fill bins of the copy sheet sorter or collator with the corresponding number of copy sets desired. A disadvantage is that the number of copy sets which can be made in one document circulation is limited by the number of available bins. Also, a sorter adds space and complexity and is not well suited for on-line finishing. However, post-collation copying and manual document placement are desirable in certain copying situations to minimize document handling. Thus, it is desirable that a pre-collation copying system be compatible with, and alternatively usable for, post-collation copying as well.

Some examples of art relating to simplex document pre-collation document recirculation systems in which each document sheet is withdrawn from the bottom of a document set stack over an imaging station for copying once in each circulation and then returned to the top of the document stack for repeated copying circulations with inversions of the document include: German Patentschrift No. 1,128,295 Oct. 25, 1962 to H. Rankers; German Offenlegungsschrift No. 2,150,563, Apr. 19, 1973 to Kalle AG; U.S. Pat. Nos. 3,937,454, issued Feb. 10, 1976, to R. H. Colwill; 4,076,408 issued Feb. 28, 1978 to M. G. Reid et al.; 4,078,787 issued Mar. 14, 1978 to L. E. Burlew et al.; 4,099,860 issued July 11, 1978 to J. L. Connin; 4,169,674 issued Oct. 2, 1979 to M. J. Russel and 4,179,215 issued Dec. 18, 1979 to C. T. Hage; and U.S. Patent Office Defensive Publication No. T957,006 of Apr. 5, 1977, based on application Ser. No. 671,865, filed Mar. 30, 1976, by M. G. Reid, et al..

The following U.S. patents are noted as specifically relating to recirculative duplex document precollation copying: U.S. Pat. Nos. 4,109,903 issued Aug. 29, 1978 to K. K. Stange et al.; 4,099,150 issued July 4, 1978 to J. L. Conin; 4,140,387 issued Feb. 20, 1979 to G. B. Gustafson; 4,158,500 issued June 19, 1979 to A. B. DiFrancesco et al; and 4,176,945 issued Dec. 4, 1979 to R. C. Holzhauser et al..

The latter two above U.S. Pat. Nos. 4,158,500 and 4,176,945 are particularly noted as disclosing selectable non-inversion paths between the bottom of the stack and the platen before imaging upstream and downstream of the platen, respectively. However, these inverter paths are for duplex documents, not simplex documents, and the documents are stacked face-up for reverse order (N to 1) copying, as in almost all of the over-platen recirculating document handlers disclosed above (see, e.g., Col. 2, lines 51–66 of U.S. Pat. No. 4,158,500).

Of particular interest as disclosing a recent 1 to N or normal forward serial order, and face-down stacking document set in a pre-collation simplex or duplex copying system herein is allowed U.S. application Ser. No. 825,743, by T. J. Hamlin et al., filed Aug. 18, 1977 and published Mar. 1, 1979 as German OLS No. 2,828,699, and an allowed divisional U.S. application Ser. No. 54,344, now U.S. Pat. No. 4,229,101 and a similar disclosure in U.S. Pat. No. 4,166,614 issued Sept. 4, 1979. However, the document stack there is not located over the platen and the documents are not inverted between the stack and the platen. Another example thereof is disclosed in U.S. application Ser. No. 52,526 filed June 27, 1979, by J. H. Looney now U.S. Pat. No. 4,234,180.

Another recent example of a duplex or simplex document recirculation pre-collation copying system is disclosed in Disclosure No. 16332, pp. 49–52, of the November 1977 issue of "Research Disclosure", published by Industrial Opportunities, Ltd., Homewell, Havant, Hampshire, U.K.. A corresponding pending U.S. application Ser. No. 813,041, was filed July 5, 1977 by J. E. Dunleavy and its equivalent U.K. application No. 2,000,749A was published Jan. 17, 1979. However, that system has one or two inversions of simplex or duplex documents between a face-up document stack over the platen to the platen.

It is known to not invert, (by reversing an otherwise inverting feed roller), duplex documents fed from a document tray over a platen to a copier platen in a non-pre-collation copying ADH system, as disclosed in IBM Technical Disclosure Bulletin, Vol. 14, No. 5, p. 1547, published October 1971.

Such sheet inverter reversal systems tend to have reliability problems, e.g., sheet jam or misfeed problems. Thus, they have generally been avoided for pre-collation multiple recirculation of simplex documents. However, the present system minimizes such document feeding problems by utilizing an inverter system only for the first, or first and last, simplex document set circulations, and not for the other circulations, regardless of the total number of circulations.

The simplex/duplex pre-collation copying system disclosed herein also avoids a non-copying initial counting circulation of the documents as described in (abandoned) U.S. application Ser. No. 57,855, filed July 16, 1979, by R. E. Smith and J. R. Yonovich for the same assignee, now allowed as continuation Application Ser. No. 172,807, which reduces first copy out time.

Other examples of copier systems with particular reference to detailed examples of control systems for both document and sheet handling are described in U.S. Pat. Nos. 4,062,061, issued Dec. 6, 1977, to P. J. Batchelor et al.; 4,123,155, issued Oct. 31, 1978, to W. L. Hubert (IBM); 4,125,325, issued Nov. 14, 1978, to P. J. Batchelor et al.; and 4,144,550, issued Mar. 13, 1979, to J. M. Donohue et al..

Conventional integral software incorporation into the copier's general microprocessor logic circuitry and software of the functions and logic defined herein, as taught by the above and other patents and copiers, is the current state of the art and is preferred. However, it will be appreciated that the functions and systems disclosed herein may be alternatively conventionally incorporated into a copier utilizing any other suitable or known copier software or hard wired logic systems, cam-bank switch controllers, etc.. The control of all of the exemplary sheet handling systems disclosed herein may be accomplished by conventionally activating them by signals from the controller in response to simple programmed commands and controlling switch inputs from the copier console selected by the operator, such as selecting the number of copies, simplex or duplex copying, whether the documents are simplex or duplex, etc.. Other switches count the document sheets and copies automatically as described hereinbelow. These signals actuate known electrical solenoid or cam controlled sheet deflector fingers and drive motors or their clutches in the selected steps or sequences programmed. Conventional sheet path sensors or switches may be utilized for counting and keeping track of the positions of documents and copy sheets. This is known in the art, and taught in the above and other patents and products. In particular, known pre-collation copying systems utilize conventional microprocessor control circuitry and connecting switches for counting the number of document sheets as they are recirculated, counting the number of completed document set circulations, and thereby controlling the operation of the document and copy sheet feeders and inverters, etc..

In summary the above art demonstrates that both forward serial order ("1 to N") and reverse order ("N to 1") pre-collation copying of original documents is known, for both simplex (one-sided) and duplex (two-sided) original documents and copies. N to 1 (reverse order) document set circulation is particularly known for feeding from the bottom of a stack of documents positioned (loaded) face-up over a platen of a copier. There the simplex documents are circulated by being turned over, copied, turned over again, and returned back to the top of the stack over the platen. Programmed microprocessor control of such copying is also known.

A major disadvantage of the prior art N to 1 or backwards document feeding and copying order is that the copier does not know what document is being fed, since the last page is fed first. In contrast, in 1 to N document feeding the first document fed is known to be page 1, which is known to be the odd page; the second document fed is known to be page 2, an even page, etc.. Thus, in 1 to N copying, the copier controller can know whether a document being copied is odd or even just from the count of the number of document sheets which have been fed from the document stack. This is not true for N to 1 document circulation. Not knowing whether the documents being fed are odd or even, and duplexing accordingly has distinct disadvantages for making duplex (two sided) copies, where if the number of original document pages is odd, the last duplex copy sheet will be blank on one side. This problem has lead to simplex/duplex copying with either pre-counting of the entire document set before copying, in a non-copying circulation, or selective use of a copy sheet inverter in the copy sheet path and other disadvantages, as explained more fully in U.S. patent applications Ser. Nos. 57,855 and 71,613, and U.S. Pat. No. 4,166,614 at Col. 18, cited above.

Precount cycles and/or selective use of a copy sheet inverter adversely affect the system reliability by requiring extra handling of the document set and running the copy sheets past additional deflector fingers and in and out of an inverter, with extra or different handling and timing. In addition, the precount cycle may decrease the perceived productivity of the system by cycling the document handler without imaging the originals at the beginning of copying when it is most noticeable and when there is no copy sheet output finishing or handling to occupy the operator's time. For a larger document set there is a corresponding increase in first copy out time for simplex/duplex copying using a precount circulation. Not knowing whether a document being fed is an odd or even page number on the first circulation particularly complicates the simplex/duplex operation of a copier when it is desired to use letterhead, binder edged, pre-punched, marginal, or other special copy sheets which require a particular face or orientation of the copy sheet to be printed or bound. For example, with letterhead paper, for duplex copying page 1 must be printed on the letterhead side, not the obverse side. Using paper with ring or spiral binder holes, the odd document pages should be copied so that the holes are on the left hand side of the page and the even document pages should be copied so that the holes are on their right. If the copier finisher has a stapler for one corner, the copy sheets should be placed in the finisher automatically in the correct orientation for stapling in the correct corners.

Another disadvantage of N to 1 document feeding is that since the count of the number of documents fed differs from the document page number, jam recovery is also more complicated. If a document feeding jam occurs, particularly during the first circulation, the copier controller cannot automatically know the page number of the document which is being copied when the jam occurred. For example, if a jam occurs on the third document sheet being fed, the copier can only tell that this is the third sheet from the bottom of the stack of documents. It is not page 3. The page number cannot be known until after counting the whole N to 1 stack once, or manual inspection, for either simplex or duplex documents.

However, N to 1 document recirculation has been commercially utilized in spite of these disadvantages because it is obviously suitable and conventional for a "racetrack" or over-platen loop circulation path, in which the documents are recirculated to and from a document stack located over the copier platen, as shown in the above-cited references. Simplex documents are fed from one edge of the stack to the same side or edge of the platen underneath the stack and back from the opposite edge of the platen to the opposite edge of the stack, and therefore may be stream fed unidirectionally over the platen, feeding one document on while the prior one is feeding off. The document path has a 180° loop turn at each side of the platen which is generally a short path. With such a shorter and unidirectional "racetrack" loop path length, document transport speeds can be lower and two or three sheet document set handling without skipped copy cycles can be achieved more easily than most nonracetrack systems.

Such an over-platen or "racetrack" system is generally also more horizontally compact than other nonracetrack pre-collation devices. For example, a 1–N "Y" configuration document recirculator using a side-by-side document stack feeder and platen transport takes up more horizontal working space on the top machine surface although it may be thinner (less vertical space). A conventional "racetrack" configuration places the document stack, document feeder, document turn transports or inverters, and platen transport all substantially overlying the platen.

The present invention overcomes many of the above and other problems and provides the above advantages of both 1 to N copying and a "racetrack" or over-platen stack document loop path.

The 1–N system disclosed herein has even further advantages. It can readily have a paper path compatible with both pre and post-collation output or finishing. Even if the paper path within the copier was originally planned for an N to 1 copy sequence, the system disclosed herein can be utilized. For example, the finisher module provided can be one which inherently inverts each output sheet before stapling the set. If the document handler is operated in post-collation mode, the finisher module can be replaced with a sorter module which also inverts each output copy sheet before placing it in appropriate bins.

Another advantage of a 1–N racetrack RDH is that it can be better selectively used as an ADF or SADH by eliminating the document return path to the stacking tray of the RDH, and instead exiting documents (either fed from the stack or manually inserted) off to the side of the platen after they are copied. This provides known alternative automatic or semi-automatic document feeding using the same basic RDH apparatus. With a 1 to N system the originals are ejected and stacked in the proper, and the same, sequence, i.e. 1–N and face-down in a document catch tray, adjacent the platen. On an N–1 racetrack RDH such ejected originals would be stacked in the wrong order (not properly collated).

A preferred feature of the invention is to provide, as disclosed hereinbelow, a method of plurally recirculating a stacked set of document sheets in normal forward serial (1 to N) page order to and from the imaging station of a copier, by, in each copying circulation, seriatim removal of the bottom-most document sheet in the stack, feeding the removed document sheet to the imaging station for individual copying, and then returning the document sheet from the imaging station to the top of the stck after it has been copied once on only one side for making plural pre-collated copy sets from the plurally circulated set of document sheets, characterized by stacking the set of document sheets face-down in normal (1 to N) order at a position overlying the imaging station with the first page on the bottom of the stack, and, in the first circulation of the set of document sheets, feeding the document sheets from the stack to the imaging station without inversion through a non-inverting path so that the document sheets are presented face-down to the imaging station, and then feeding the document sheets from the imaging station back to the top of the stack with a single inversion, so that the document sheets are returned to the stack face-up, inverted from their said original face-down orientation in the stack, and then, in subsequent recirculations of the document set, feeding the document sheets from the stack to the imaging station with a single inversion through an inverting path so that the document sheets are turned over between the stack and the imaging station and presented face-down on to the imaging station, and then feeding the document sheets from the imaging station back to the top of the stack with a single inversion so that a total of two inversions are provided for the document sheets in said subsequent circulations thereof.

Preferably, in a final circulation of the document set the document sheets are circulated as in said first circulation, with only a single inversion, but without copying, to restack the document sheets in the stack in their original face-down orientation.

In said first circulation, the direction of motion of the document sheets is preferably reversed after they are fed out from under the bottom of the stack, to provide said non-inverting path between the stack and imaging station. This may be provided by normally transporting the document sheets from the bottom of the stack to the imaging station around an inverting roller in said subsequent circulations, but which inverting roller is reversed for each sheet in said first and last circulations to reverse the direction of motion of each sheet to provide said non-inverting path for the document sheets.

Reverse page order (N to 1) document pre-collation copying may be selectively alternatively provided with the same copier and imaging station as for the 1 to N system disclosed herein by stacking the document sheets face-up at the same stacking position overlying the imaging station and circulating the documents as in said subsequent circulations.

Figure 2:
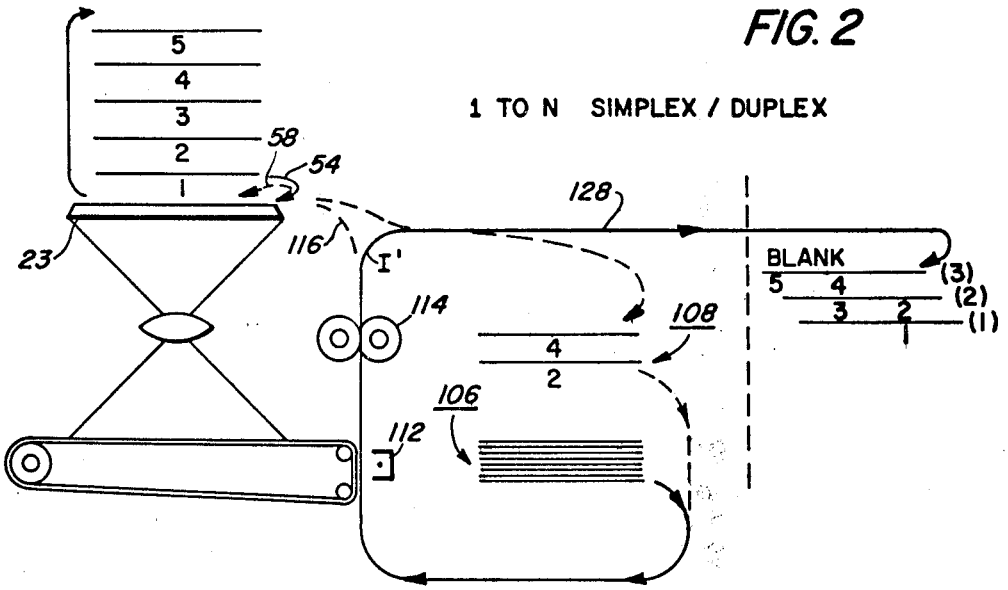
Figure 3:
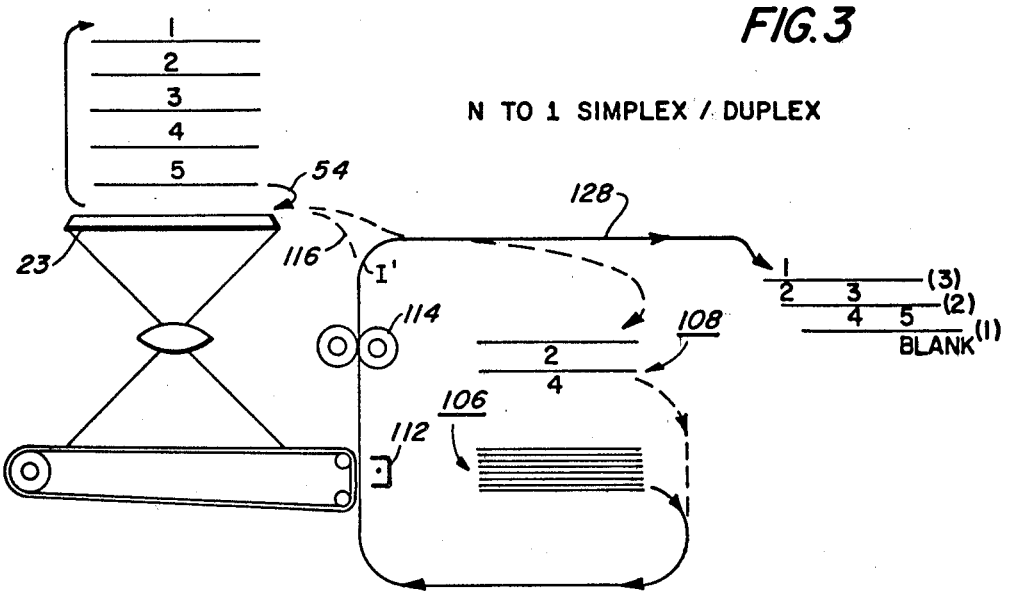

Further features and advantages of the invention will be better understood by reference to the following description, and to the drawing forming a part thereof, wherein:

FIG. 1 is a schematic side view of an exemplary copier and an exemplary document feeder therefor utilizing the present invention; and FIGS. 2 and 3 are schematic document and copy paths of exemplary simplex/duplex copying on the apparatus of FIG. 1 for 1 to N and N to 1 order copying, respectively, of a 5 page example, FIG. 3 being provided for comparison with the method of FIG. 2 taught here.

Referring to the exemplary xerographic copier 10 shown in FIG. 1, and its exemplary automatic document feeding unit 20, it will be appreciated that various other alternative recirculating document feeding units and copiers may be utilized with the present invention, including various ones disclosed in the above-cited references.

In the exemplary recirculating document handler (RDH) 20 disclosed here, individual original document sheets are sequentially fed from a stack of document sheets placed by the operator face-down in normal forward collated order in the document stacking and holding tray 22, i.e. with page 1 on the bottom of the stack, facedown. The document sheets are fed from the bottom of the stack seriatim to the imaging station 23, which is the conventional copying platen of the copier 10, to be conventionally imaged onto a photoreceptor 12 for the production of copies in a generally conventional xerographic manner. The documents are stacked initially, and also restacked automatically during each circulation, in the tray 22 over the platen 23. The document handler 20 has conventional switches or other sensors such as 24 for sensing and counting the individual documents fed from the tray 22, i.e. counting the number of document sheets circulated. A conventional resettable bail or finger drops to indicate through its associated switch or sensor 26 the completion of each circulation of the complete document set, by sensing that all the documents have been fed out from under it, and then is automatically reset on the top of the stack before the next circulation. The document feeder 20 is adapted to serially sequentially feed the documents, which may be various conventional sizes and weights of sheets of paper or plastic containing information indicia to be copied on one or both sides, e.g. printed or typed letters, drawings, prints, photographs, etc.. A bottom feeder 28 feeds the bottom-most document sheet, on demand by the controller, from the stack through one of two selected feed paths described below to a platen drive 30 which moves the document into a registration position, against a registration gate 32, over the copier platen 23, where the side of the document facing the platen 23 is copied.

In this document feeder 20 each document is selectably inverted or not inverted as it is fed from the tray 22 to the imaging station 23 through one of two paths selectable by the controller. Thus, this is accomplished here before the document is copied. The two paths here are provided by a selectably reversable sheet drive roller (inverting roller) 40 and a selectable position gate or deflector 60 in the document path. Each document sheet is fed initially from tray 22 around the outside of the roller 40. If the document path is continued around roller 40, it is fed invertedly through a first path 54 onto the platen 23, conventionally. However, the decision gate 60 in the document path here is adjacent the entrance to roller 40 and comprises pivotable, normally raised, deflector fingers which may be lowered after the trail edge of the document has passed this gate. (Switch 24 or another switch can sense the trail edge and start a count of sufficient time for it to pass). Subsequent actuation of the gate 60, together with coordinated reversal of the roller 40, causes the further recirculatory movement of the document to reverse and pass through a second and different transport path 58 to the platen for copying. In the art this is called an "inverter" even though the document is not inverted at this point, as described below. The second transport path 58 provides no sheet inversion between the stack and the platen, whereas the first transport path 54 inverts the document sheet (once) between the stack and the platen.

In the inverter operation for path 58, the reversal of the roller 40 causes the documents to only go partially around the roller 40 and then be reversed in direction and fed directly back through the gate 60. The now deflecting down gate 60 (as shown in its solid line position in FIG. 1) deflects the document into the path 58 which feeds directly onto the platen 23.

Thus, in this non-inverting path 58, the documents arrive at the platen with the same orientation as their original orientation in tray 22. Simplex documents stacked face-down in the tray 22 will thereby still be face-down when they reach the platen 23 for copying, providing the path 58 is utilized.

In contrast, the first inverting transport path 54 transports the documents unidirectionally and without reversal fully around the roller 40 onto the platen 26. Thus, the orientation or facing on the copy platen 23 of documents fed through the simplex path 54 is inverted from the previous orientation of those documents in the tray 22.

It may be seen that the return path of the documents to the tray 22 from the platen after they are copied is always the same here, regardless of which of the two initial paths 54 or 58 is used. This document return path has one sheet inversion, provided by feeding the documents around a second, but non-reversing, inverting roller document feeding system 42, which also returns the documents to restack on the top of the stack in tray 22.

Thus, in the total circulation path from the bottom of the tray 22 back to the top thereof, with the selection of the transport path 54 the documents are inverted twice around both rollers 40 and 42, whereas with the selection of the transport path 58 the documents are only inverted once. Therefore, it may be seen that the reversal or non-reversal of the roller 40 and the coordinate actuation or non-actuation of the selector gate 60 therewith during a document set circulation determines whether that set of documents will be recirculated with a total of one or two inversions in that circulation. (In either case, since the documents can be continuously restacked simultaneously with continuous feeding by the feeder 28, continuous multiple recirculations can be provided for pre-collation copying). With two total path inversions per circulation (i.e. utilizing the path 54), there is effectively no inversion per circulation. Thus, the documents will be restacked in the tray 22 in their same original orientation, and the same sides of the documents will be exposed in the next circulation. In contrast, with only one total path inversion per circulation (using the path 58) the documents will be restacked in the tray 22 inverted from their previous orientation. Thus, the apparatus of path 58 is referred to as the "inverter" because its total circulation path effect is inversion, even though its local effect is actually non-inversion as noted above.

The inversion step or path 58 is normally used to copy the opposite sides or faces of duplex documents in their subsequent circulation loop, as shown in the above-cited art. However, the present system utilizes this path and apparatus for a very different function and purpose, namely to copy simplex documents in forward serial (1 to N) order.

In the method of pre-collation copying of a set of plural (multi-page) simplex document sheets disclosed herein, the document sheets are presented to the imaging station 23 of the copier 10 in forward serial (1 to N) page order. They are multiply recirculated between the stacked set of the document sheets and the imaging station, and copied only once on one side per circulation at the imaging station, by feeding the document sheets seriatim from the bottom of the stack to one side of said imaging station and then returning the document sheets from the opposite side of said imaging station to the top of said same stack, in a recirculatory loop path, in said multiple circulations. The set of document sheets are stacked in proper page order, but face-down, with the first page on the bottom of the stack, in the stacking position 22 overlying the imaging station 23. In only the first and last circulations of said document set, the document sheets are fed through the first document path 58, between the stack and said one side of the imaging station, which first document path reverses but does not invert the document sheets. In all other circulations of the document set other than said first and last circulations, the document sheets are fed through the second document path 54 with a single inversion from the stack to said same one side of said imaging station, so that the document sheets are circulated in a uni-directional endless loop path. In all of the document circulations the document sheets are fed from said imaging station back to said stack with a single inversion. Thus, during the first and last circulations the document sheets are inverted a total of only once per circulation and returned to the stack inverted from their previous orientation, but during the other circulations the document sheets are inverted a total of twice per circulation to maintain the same orientation of the document sheets in said stack. The simplex document sheets are copied in said first and said other circulations, but not in said last circulation. For making duplex copies from said simplex document sheets in this manner in said first circulation and the next-to-last circulation of said document sheets only the first and every alternate document sheet are copied at said imaging station. Since no hardware changes are required, reverse page order (N to 1) document pre-collation copying may selectively alternatively be provided with the same document handler, same copier, and same imaging station by stacking the document sheets face-up at the same position overlying the imaging station and circulating the documents as in the subsequent circulations described above, merely by applying a different selectable software program to the copier programmer.

As previously described, the operation of inverter mechanisms utilizing a reversal path can increase reliability problems, particularly if it must be frequently used for multiple recirculations of a document set. The present system uses, but minimizes the use of, this normally duplex document transport path 58 for simplex documents. Here this minimizes the reversals of the roller 40 and the operations of the gate 60 (or any other sheet inverting mechanism which might be used instead). With the system disclosed herein, all but the first and last of the simplex document set circulations may be a simple non-inverting, non-reversing, continuous loop path provided through the normal simplex document path 54. Thus, the number of circulations through the inverting path 58 is normally much less than the total number of circulations (the number of copy sets made) with this system. Further, this system is fully compatible with duplex document recirculation without increasing the number of inverter operations for the duplex documents either.

The exemplary copier 10 processor and its controller 100 will now be described in further detail. The copier 10 conventionally includes a xerographic photoreceptor belt 12 and the conventional xerographic stations acting thereon for respectively charging 13, exposing 14, developing 15, driving 16 and cleaning 17. The copier 10 is adapted to provide duplex or simplex pre-collated copy sets from either duplex or simplex original documents copied from the same RDH 20. Two separate copy sheet trays 106 and 107 are provided for feeding clean copy sheets selectably from either one. They are known as main tray 106 and auxiliary tray 107. The control of all sheet feeding is, conventionally, by the machine controller 100.

The controller 100 is preferably a known programmable microprocessor, exemplified by the art cited above, which conventionally also controls all of the other machine steps and functions described herein including the operation of the document feeder, the document and copy sheet gates, the feeder drives, etc.. As further disclosed in those references, the controller 100 also conventionally provides for storage and comparison of the counts of the copy sheets, the number of documents recirculated in a document set, the number of copy sets selected by the operator through the switches thereon, time delays, jam correction control, etc..

The copy sheets are fed from a selected one of the trays 106 of 107 to the xerographic transfer station 112 for the conventional transfer of the xerographic toner image of a document page to the first side of the clean copy sheet. The copy sheets here are then fed by a vacuum transport to a conventional roll fuser 114 for the fusing of the toner image thereon. From the fuser, the copy sheets are fed onto a gate or fingers 118 which functions as an inverter selector. Depending on the position of the gate 118 the copy sheets will either be deflected into a conventional sheet inverter 116 or bypass the inverter 116 and be fed directly onto a second decision gate 120. Those copy sheets which bypass the inverter 116 turn a 90° corner in the sheet path before reaching the gate 120, which inverts the copy sheets into a face-up orientation, so that the image side which has just been transferred and fused is face-up at this point. If the inverter path 116 is selected the opposite is true (the last printed face is down). The second decision gate 120 then either deflects the sheets directly into an output tray 122 or deflects the sheets into a transport path which carries them on without inversion here to a third decision gate 124. This third gate 124 either passes the sheets directly on without inversion into the output path 128 of the copier, or deflects the sheets into a duplex inverting roller transport 126. The inverting transport 126 inverts and stacks copy sheets to be duplexed in a duplex tray 108 when the gate 124 so directs. The duplex tray 108 provides intermediate or buffer storage for those copy sheets which have been printed on one side and on which it is desired to subsequently print an image on the opposite side thereof, i.e. the sheets being duplexed. Due to the sheet inverting by the roller 126, these buffer set copy sheets are stacked into the duplex tray 108 face-down. They are stacked in this duplex tray 108 on top of one another in the order in which they were copied.

For the completion of duplex copying, the previously simplexed copy sheets in the tray 108 are fed seriatim by its bottom feeder 109 from the duplex tray back to the transfer station 112 for the imaging of their second or opposite side page image, through basically the same copy sheet path as is provided for the sheets from the trays 106 or 107. It may be seen that this copy sheet feed path here between the duplex tray feeder 109 and the transfer station 112 has an inherent inversion which inverts the copy sheets once. However, due to the inverting roller 126 having previously stacked these sheets face-down in the tray 108, they are presented to the transfer station 112 in the proper orientation, i.e. with their blank or opposite sides facing the photoreceptor 12 to receive the second side image. The now duplexed copy sheets are then fed out through the same output path through the fuser 114 past the inverter 116 to be stacked in tray 122 or fed out past the gate 124 into the output path 128.

The output path 128 transports finished copy sheets (simplex or duplex) either to another output tray, or, preferably, to a finishing station where the completed pre-collated copy sets may be separated and finished by on-line stapling, stitching, glueing, binding, and/or offset stacking.

It is desirable to minimize the operation of the copy sheet output inverter 116, in order to simplify and shorten the paper path and increase its reliability. Its use also depends on the inherent inversions provided within the paper path of the copier. The exemplary conventional inverter 116 here operates by the gate 118 deflecting a copy sheet face-down into the first or lower nip of the illustrated three roll inverter, which drives the sheet into the inverter chute. The copy sheet's movement is then reversed within the curved inverter chute by known or suitable sheet reversing means, e.g., further rollers, or resilient rebound members, and the copy sheet is then reversed and driven out of the inverter 116 through the second or upper nip of the same three roll inverter directly toward the gate 120. The convex shape of the inverter chute acting on the beam strength of the sheet causes the sheet trail edge to flip up toward this second nip. The copy sheet output from the inverter 116 to the gate 120 here is thereby face-down. Note that the inverter 116 here is positioned at a corner of an otherwise inherent 90° paper path inversion as described above. However, any other suitable sheet inverter may be utilized, and may be provided at different positions in the copy sheet output path. Examples of similar or substitutable sheet inverters are disclosed in U.S. Pat. Nos. 2,901,246; 3,337,213; 3,416,791; 3,523,687; 3,856,295; and 4,044,285.

By way of further background, as to the difficulties in copy sheet output orientation and order for pre-collation, for which the inverter 116 may be utilized, there are several well known problems and solutions in maintaining the proper collation of the copy sheets in the output tray or finisher, particularly with reproducing machines which must do both simplexing and duplexing. For example, if simplex copy sheets are generated in forward serial (1 to N) page order, these simplex copy sheets can be properly collated by being output stacked seriatim on top of the prior sheets in the same order, if they are stacked face-down. If this is done, then when the operator picks up an individual completed stack or bound set of copy sheets and turns it over, it will be in the proper forward page order (1 to N) from the top of the stack to the bottom thereof. It is known that the desired sheet orientation may be provided by appropriate inversions within the copier processor paper path itself, or in the copier paper output path, or by using a selectable (bypassable) inverter such as 116 in the copy output path, or by having an inverting path or inverter in the associated output stacking and/or finishing station to which the copies are fed. FIG. 2 illustrates such inverted output stacking for face-down 1–N output whereas FIG. 3 shows face-up N-1 stacking.

The same is true for duplex copying output, but with additional output collation difficulties and requirements, depending on which side is printed last, etc.. A lower and odd, document page number must be on one side of a duplex copy sheet and the next higher, and even, document page number must be on the opposite side of that copy sheet; so that the 1 to N outputted duplex copies are in the proper page order $\frac{1}{2}$; $\frac{3}{4}$; 5/6; etc.. Providing collated output without an inverter is made more difficult by the fact that the total overall copy sheet path for the copies being duplexed is typically different, i.e., contains more inversions, than the overall copy path for copy sheets which are only being simplexed, since it is necessary to turn the duplex copy sheet over to present its opposite side for the second copying pass. In the particular duplex sheet path herein (which can be changed) each sheet to be duplexed is inverted once at the duplex tray input 126, a second time in the return path to the transfer station 112, and a third time in the path from the transfer station 112 to the output 128, to exit last-printed-face-up. Thus, if the second sides printed are the even sides, a 1 to N output may be stacked with these last-printed even sides facing up, rather than down as for simplex. But, if the 1 to N order second sides printed last are odd they may be stacked in the output face-down as in FIG. 2. It is desirable to have commonality, i.e., to utilize the same sheet feeding path to the maximum extent possible for both duplex and simplex copies, and to thus avoid using a selectable output inverter for either. However, this is not essential. Here, for the reasons described, it is preferred, but not essential, to print the odd page number sides last for simplex/duplex, i.e. to put even side copies 2, 4, 6, etc., into the buffer tray 108.

In the 1 to N simplex/duplex document copying sequence in FIG. 2 the next lower, and odd, page numbers are properly printed on the second side of the duplex copy sheets in their second pass through the transfer station 112 here. That is, page one is printed on the back of the page two sheet and this first duplex copy sheet (1) is exited with page 1 down. The second duplex copy sheet (2) has page 3 printed on the back of the sheet with page 4 and exits on top of the first sheet, etc.. This is schematically illustrated in the 5 page 1–N example of FIG. 2. The inverter 116 path is illustrated in FIG. 2 as an alternative. However, as otherwise discussed herein, it is bypassed (path I') here and an inherent inversion is provided in the output stacking instead. This same path in FIG. 2, avoiding the inverter 116, is also used for simplex copies made from the RDH unit, which is an important advantage.

If it is desired to pivot away the RDH 20 from the platen 23 to provide alternative manual document copying in the normal 1 to N page order, or to provide an SADH which is manually stream fed by the operator in normal 1 to N order, the output inverter 116 also need not be utilized here. Face-down output with proper collation for simplex or duplex copies is provided in this case as well, where the output provides a natural inversion as in FIG. 2, i.e. the same paper path may be used for all these copying modes here.

As noted above, pre-printed, e.g. letterhead, paper sheets cannot have a first even page printed on the front (pre-printed) side. Page 1 must be on the letterhead side and oriented with the printing direction. This is an additional complication for duplex copies, further discussed below.

By way of further background, as noted above, there is an additional problem in the situation where there is an odd rather than even number of simplex document pages to be copied onto a duplex copy set. This encourages the copying of even pages first and odd pages last (onto the backside of even page copy sheets fed from the buffer tray 108). With an odd number of document pages the Nth or last page of the set of duplex copies made therefrom is really a simplex copy, because the last copy sheet page in each copy set will have an image on only one side thereof. It is undesirable to run this last duplex copy sheet through the transfer station a second time for the pseudo printing of a blank image on the backside thereof, simply to obtain an additional inversion of that last sheet to maintain output collation, since this wastes processing time and also can cause undesirable background contamination of the blank backside of this last sheet. This can be avoided by only putting even pages in the duplex tray 108 and directly outputting the Nth duplexed copy sheet immediately after its first side is printed rather than feeding it into the duplex tray. Thus, this last odd page can be printed on a clean copy sheet fed from a copy sheet tray, rather than from the duplex tray. (However, this normally results in this last copy sheet having a different number of inversions, as discussed below). Copying the odd page sides last also makes the output of duplex copies consistent with simplex copies, i.e., using exactly the same number of output inversions for proper collation.

However, to treat an Nth odd duplex copy page differently in this manner, it must be known in advance whether there is an odd or even number of simplex documents. Where the documents are being copied in forward serial order, i.e. 1 to N, in this system, this is not a problem. The Nth copy sheet page will only need to be fed and copied after the last (Nth) document in the set has been counted, and the bail switch 26 actuated, which determines whether or not N is an odd number. Note in FIG. 2 that it is the last copy sheet (3) in the output tray that has a "blank" page on the back of the last odd page 5.

Note in contrast that when the simplex documents are copied in reverse serial order (N to 1), as in FIG. 3, that now the first (Nth) duplex copy sheet (1) fed will be the one requiring special duplex processing, i.e., having a blank backside when N is odd. Since this Nth copy sheet is fed first it is not known whether the Nth document page is odd or even until after the first document set circulation which reduces the efficiency of the system.

The present system does not have this problem. Taking, for example, a five page simplex document set of five simplex document sheets to be duplex copied with the present system, they would be loaded face-down into the tray 22 in their proper bottom-to-top page order: 1, 2, 3, 4, 5, as shown in FIG. 2. They would then be copied here in their first circulation through path 58 in that same forward page order. However, in the first circulation the odd documents would not be copied so that the buffer tray 108 would be loaded with only two copy sheets printed with pages 2 and 4 only, face-down, with page 2 on the bottom, as shown. On the next, and all but the last, document circulations all document pages are copied. However, in the second document set circulation the odd document pages 1 and 3 are copied in that order, respectively, onto the copy sheets bearing pages 2 and 4 fed from the duplex tray 108. But the Nth odd page 5 here may be fed onto a clean copy sheet fed from tray 106 or 107. The controller 100 already knows that N is an odd page, because the entire set has been counted by that point in time with this 1 to N system. Thus, the controller knows what Nth copy sheet to feed and whether or not to invert it. Meanwhile, also during said second document set circulation the even pages 2 and 4 are being copied again and fed into duplex tray 108 in preparation for the third document circulation. This is repeated for as many circulations as desired (the number of desired copy sets dialed into the controller 100). Then on the final circulation only the odd document pages are copied to empty the buffer tray 108.

For said simplex/duplex copying, by loading letterhead or other special paper face-down in the trays 106 and 107 and copying even page documents on the first circulation, the even pages will be properly printed on the backsides of the letterhead copy sheets here, since the copy paper path here contains one inversion between trays 106 and 107 and the transfer station 112. Then on the next circulation these duplex copy sheets will have odd pages 1, 3, 5, etc. properly printed on their first (letterhead) sides. Thus, there is no problem with an even number of document pages. However, for an odd number of document pages, the above-described special processing of the last (simplex) copy sheet would cause the last odd document page to be improperly printed on the backside of a clean letterhead copy sheet fed from tray 106 or 107.

This can be avoided by providing a "special paper" or "letterhead paper" or the like operator button on the copier console for the controller 100. The controller can then be programmed to detect the quadruple coincidence of signals from (1) this "special paper" button being pressed, (2) an odd document sheet count (which is available in advance of the last copy in this 1 to N system), and (3) the "simplex document" and (4) "duplex copy" buttons also having been pressed. Upon detection of all four conditions the controller 100 can direct an extra or "dummy" final (N+1) "even" page copy to be made and fed to the duplex tray 108 (as if there were a real N+1 even document page). No document is fed, only a copy sheet, and the conventional photoreceptor erase lamp or document exposure lamps are turned on to discharge the photoreceptor in the area which meets up with this "blank" copy sheet in the transfer station, so that no significant toner is transferred thereto. This "dummy" or blank letterhead page is now properly inverted to receive the real odd Nth document page on its letterhead side. As an alternative, this can be done without a "special paper" button in all cases where the three conditions (2), (3) and (4) occur. [Note that (3) and (4) may be a single combined "simplex/duplex" signal]. Alternatively, if odd pages are copied first, the odd Nth page can be copied onto a clean copy sheet and differently inverted. In FIG. 2 this would require inverting in 116 all but the 3rd copy sheet "blank/5" output and the duplex tray 108 would have sheets 3 and 1 rather than 4 and 2 as shown, respectively, but would consistently properly handle face-up loaded special paper from 106. Thus, all papers may be loaded the same way (same facing and orientation) in trays 106 or 107 regardless of the copying mode.

At the end of the last circulation of the document set the documents preferably have been automatically restacked properly re-collated in the document handler tray 22, for removal in collated order by the operator. With this system they are automatically so restacked in the proper order at the end of copying. A non-copying set circulation of simplex documents in an inverting circulation through path 58 provides this recollation of the document sheets on the last circulation restacked face-down in the tray 22. This last circulation starts while the final copy sheets made on the previous (last copying) circulation are being stacked or finished, and being removed by the operator, so there is little perceived time loss in waiting for the documents to recollate. Since it is a noncopying circulation after copying, a document jam in the inverter will not interrupt or affect the completion of the copy run.

A duplex/duplex copying system, compatible with the simplex/simplex and simplex/duplex systems disclosed herein, can provide as disclosed in the above-cited U.S. Pat. No. 4,166,614 to T. J. Hamlin et al. and its related cases or the cited U.S. Ser. Nos. 71,613 or 57,855. Briefly, the duplex documents may be loaded face-down and copied 1 to N as in the former cases or loaded face-up and copied in N to 1 order as in the latter applications. In either case, the preferred duplexing system is to copy only one side of each duplex document sheet in each circulation, storing the copies thereof in the duplex tray 108, turning the document sheets over during a circulation, and copying all of the opposite sides of all the document sheets onto the opposite sides of the copy sheets fed back from the duplex tray 108.

For compatible duplex/duplex copying here, the duplex documents are preferably loaded face-down in the same over-platen stacking area and copied in the same 1 to N order as the simplex documents. Thus, loading an exemplary seven page (4 sheet) duplex document set into the tray 22 face-down, the duplex document pages in the tray 22 would be in the initial stacked page order, top-to-bottom, of: blank/7; 6/5; 4/3; 2/1. The first document sheet, pages 1/2, would be on the bottom of the stack with page 1 facing down. To copy such a duplex document set so that the even page sides are copied first, as is preferred for duplex copying here, the duplex path 54 would be utilized in the first circulation of the document set. (Note that this is opposite to the first circulation document path 58 selection for simplex documents described above). The controller 100 is instructed by its software to provide this path in response to the "duplex document" switch on its console having been actuated by the operator. Since duplex/simplex copying is not provided here, this same duplex document switch also automatically selects the duplex copy mode. On the first duplex document circulation, the first duplex document sheet 1/2 will be inverted as it is fed from the stack to the platen through path 54, thereby placing the page 2 side of the document sheet face-down on the platen 23 to be copied. The following pages 4, 6 and blank would then be fed to be copied in the same manner. For the subsequent circulations in which the opposite (odd page) sides of the 1 to N order duplex document set are copied the other document feed path 58 would be initially utilized. The path 58 would present the duplex document odd pages 1, 3, 5 and 7 to the platen in that order to be copied, and then they would automatically restack in tray 22 with the even page sides down. Thus, in following circulations the non-inverter path 54 may be utilized to re-present the same sides to the platen.

Thus, this simplex/duplex system is fully compatible with the system disclosed in the above-cited U.S. Pat. No. 4,278,344 to R. B. Sahay, in which the inverter (40, 60) path 58 is only utilized intermittently between successions of plural copying circulations, i.e. in which plural buffer sets are placed in the duplex tray 108 and the document inverter operation path 58 is utilized only during single document circulations at the beginning or end of a succession of circulations, after the document set has been circulated by a number of times equal to the copy sheet capacity of the tray 108 divided by the number of document sheets in the document set, thereby significantly reducing the number of circulations requiring the operation of the inverter, except for very large document sets. Thus, for the above example of a four sheet duplex document set, and with an example of a 100 sheet capacity duplex tray 108, dividing four into one hundred gives a 25 circulation number. Thus, the set of duplex documents here would be circulated 25 times through path 54 at the beginning of copying to form 25 four sheet buffer sets in the tray 108; i.e. 25 sets of four copy sheets each bearing pages 2, 4, 6, blank, respectively. Then on the 26th document circulation the duplex document set would be circulated once through the path 58. Then the document set would be circulated again through the path 54 for the next 24 circulations. Thereby, in circulations 26 through 50 here, the pages 1, 3, 5, and 7 would be printed in that order 25 times on the back of the buffer set sheets fed from the duplex tray 108 until all 25 duplex copy sets have been printed and exited. Then this sequence would repeat, (assuming that more than 25 copy sets had been requested by the operator through the appropriate switch selection in the controller 100).

The disclosed copier and document handler unit here can automatically handle a wide latitude of original document sets with a minimum of operator interaction. In a typical job, the operator need only drop the set of documents to be copied into the open loading tray 22 on top of the RDH 20, program the desired number of copies to be made in the controller 100 switches, indicate if duplex documents rather than simplex have been loaded (by pressing a button on the controller 100), and then initiating the copying run sequence by pressing the conventional "start print" button on the controller. There may, of course, be some adjustment needed for side or rear guides in the tray 22 for different sizes of documents. Except for jam clearance, there would normally be no other operator interaction required with the copier or document handler to provide pre-collated output sets.

While the 1 to N simplex document precollation copying system disclosed herein is preferred, it will be appreciated that various alternatives, modifications, variations or improvements thereon may be made by those skilled in the art, and the following claims are intended to encompass all of those falling within the true spirit and scope of the invention.

I claim:

1. In a method of plurally recirculating a stacked set of plural simplex (one image side) document sheets seriatim to and fromm the imaging station of a copier, by, in each copying circulation, seriatim removal of the bottom-most simplex document sheet in the stack, feeding the removed simplex document sheet to the imaging station for individual copying, and then returning the document sheet from the imaging station to the top of the stack after it has been copied once on only said one image side; for making plural pre-collated copy sets from the plurally circulated set of simplex document sheets, the improvement comprising:

stacking the set of simplex document sheets image face-down in normal (1 to N) image page order at a position overlying the imaging station with the first said page on the bottom of said stack, in only the first and last circulations of the set of simplex document sheets, feeding the simplex document sheets from the bottom of the stack to the imaging station without any inversion through a non-inverting path so that the simplex document sheets are presented image face-down to the imaging station for copying in normal forward serial (1 to N) page order in said first circulation, and feeding the simplex document sheets from the imaging station back to the top of the stack with a single inversion in all circulations so that in said first circulation the simplex document sheets are returned to the stack image face-up (inverted from their said original face-down orientation in the stack) and not properly collated, in all circulations of the document set except said first and last, feeding the simplex document sheets from the bottom of the stack to the imaging station with a single inversion through an inverting path (integral said non-inverting path) so that the simplex document sheets are inverted between the stack and the imaging station and presented image face-down onto the imaging station, and feeding the simplex document sheets from the imaging station back to the top of the stack with a single inversion in all circulations, so that a total of two inversions are provided for the simplex document sheets in all circulations thereof except the first and last, and so that in all said circulations except said last circulation only the same one said image side of each said simplex documents is presented face-down to said imaging station for copying, and in said last circulation the simplex document sheets are circulated without copying and with a total of only one inversion to recollate said stack.

2. The method of claim 1, in which in only said first and last circulations the direction of motion of the simplex document sheets is reversed after they are fed out from under the bottom of the stack, to provide said non-inverting path between said stack and said imaging station.

3. The method of claims 1 or 2, in which the simplex document sheets are transported from the bottom of the stack to the imaging station on an inverting roller in all said circulations, which inverting roller is reversed for each said sheet thereon in only said first and last circulations to reverse the direction of motion of each said sheet to provide said non-inverting path for simplex document sheets for only said first and last circulations.

4. In a method of pre-collation copying of a set of plural (multi-page) simplex (one-image-side) document sheets in which the one image side of said simplex document sheets are presented to an imaging station of a copier seriatim and multiply recirculated between a stacked set of said document sheets and said imaging station, and copied only once on said one side per circulation at said imaging station, by feeding said document sheets seriatim from the bottom of said stack to one side of said imaging station and then returning the document sheets from the opposite side of said imaging station to the top of said same stack in a recirculatory loop path in each said circulation, the improvement comprising:

stacking said set of simplex document sheets in proper page order, but image face-down, with the first image page on the bottom of the stack, in a stacking position overlying said imaging station, in only the first and last circulations of said document set, feeding said simplex document sheets through a first document path between the bottom of said stack and said one side of said imaging station, which first document path does not invert said simplex document sheets, and in all other circulations of said document set other than said first and last circulations, feeding said simplex document sheets through a second document path with a single inversion from said stack to said one side of said imaging station, and wherein for all of said circulations said simplex document sheets are fed from said imaging station back to said stack in a third document path with a single inversion, so that said document sheets are circulated in forward serial page order, and circulated in a uni-directional endless loop path in all but said first and last circulations, so that during said first and last circulations said simplex document sheets are inverted a total of only once per circulation and returned to said stack inverted from their previous orientation, and so that during all said circulations other than said first and last circulations said simplex document sheets are inverted a total of twice per circulation to maintain the same sheet orientation in said stack, so that in all said circulations except said last circulation the same one (image) sides of said simplex document sheets are presented for copying to said imaging station in forward serial page order.

5. The method of claim 4, in which in only said first and last circulations the direction of motion of the simplex document sheets is reversed after they are fed out from under the bottom of the stack to provide said non-inverting first document path between the stack and imaging station.

6. The method of claims 4 or 5, in which the simplex document sheets are transported from the bottom of the stack to the imaging station around an inverting roller in all circulations, but which inverting roller is reversed for each sheet in only said first and last circulations to provide said non-inverting first document path for the simplex document sheets for said first and last circulations.

7. The method of claims 4 or 5, in which a major portion of said first and second document paths are common, and wherein said simplex document sheets are reversed in direction in said common portion in only said first and last circulations.

* * * * *